US006432823B1

(12) United States Patent
Huynh et al.

(10) Patent No.: US 6,432,823 B1
(45) Date of Patent: Aug. 13, 2002

(54) OFF-CONCENTRIC POLISHING SYSTEM DESIGN

(75) Inventors: Cuc K. Huynh, Jericho; Paul A. Manfredi, Waterbury Center; Thomas J. Martin, Franklin; Douglas P. Nadeau, Underhill; Yutong Wu, South Burlington, all of VT (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/433,681

(22) Filed: Nov. 4, 1999

(51) Int. Cl.[7] ..... H01L 21/302

(52) U.S. Cl. ..... 438/690; 438/691; 438/692; 438/693

(58) Field of Search ..... 438/690, 691, 438/692, 693

(56) References Cited

U.S. PATENT DOCUMENTS 4,587,768 A * 5/1986 Doyle ..... 51/124 R
5,187,901 A * 2/1993 Karlsrud ..... 451/287
5,545,076 A 8/1996 Yun et al.
5,567,199 A 10/1996 Huber et al.
5,724,144 A * 3/1998 Muller et al. ..... 356/382
5,733,175 A * 3/1998 Leach ..... 451/41
5,816,891 A * 10/1998 Woo ..... 451/6
6,152,806 A * 11/2000 Nystrom ..... 451/36

* cited by examiner

*Primary Examiner*—Benjamin L. Utech
*Assistant Examiner*—Vanessa R.
(74) *Attorney, Agent, or Firm*—DeLio & Peterson, LLC; John J. Tomaszewski; Howard J. Walter, Jr.

(57) ABSTRACT

An apparatus and method of planarizing objects, particularly electronic components. The off-concentric polishing system of the present invention comprises at least two polishing platens positioned adjacent each other such that the polishing portions of the platens are substantially co-planar. At least one wafer carrier is moveably mounted over the at least two platens such that a wafer may be polished by more than one platen substantially simultaneously. The platen configurations may be in a linear or non-linear configuration such that the wafer being polished is no longer centrally disposed over a single platen but is off-concentrically positioned over multiple platens. The off-concentric positioning of the wafer provides enhanced slurry distribution and endpoint detection. The present invention reduces time and cost in manufacturing electronic components by engaging several polishing conditions simultaneously without the need for sequential polishing.

5 Claims, 4 Drawing Sheets

OFF-CONCENTRIC POLISHING SYSTEM DESIGN

BACKGROUND OF THE INVENTION

1. Field of the Invention

This invention is directed to a method and apparatus for chemical mechanical polishing, particularly in the manufacture of semiconductor wafers.

2. Description of Related Art

Fabrication of semiconductor integrated circuits (IC) is a complicated multi-step process for creating microscopic structures with various electrical properties to form a connected set of devices. As the level of integration of ICs increases, the devices become smaller and more densely packed, requiring more levels of photolithography and more processing steps. As more layers are built up on the silicon wafer, problems caused by surface non-planarity become increasingly severe and can impact yield and chip performance. During the fabrication process, it may become necessary to remove excess material in a process referred to as planarization.

Chemical mechanical polishing (CMP) is well known in the art as a planarization technique in the manufacture of semiconductor wafers. CMP involves the use of a polishing pad affixed to a circular polishing table and a holder to hold the wafer face down against the rotating pad. A slurry containing abrasive and chemical additives is dispensed onto the polishing pad. The polishing pad is typically chosen for its hardness, compressibility and ability to act as a carrier of the slurry and to wipe away the grit and debris resulting from the polishing action. As the wafer and polishing pad rotate relative to each other, the rotating action along with the abrasive and chemical additives of the slurry, result in a polishing action that removes material from the surface of the wafer. Protrusions on the surface erode more efficiently than recessed areas leading to the flattening or planarization of the wafer surface.

In conventionally designed CMP tools, the relative linear speed at the center of the carrier and thus, also at the center of the wafer, is affected by the rotation of the platen only. At other points on the wafer, particularly on the wafer edge, planarization of the wafer is affected by the rotation of both the carrier and the platen. The ability to "match" the rotations of the platen and the wafer carrier, although at different velocities, provides greater uniformity in polishing. As there are a limited number of variables to work with, it is difficult, if not impossible, to find substantial rotational optimization between the platen and the carrier.

Another disadvantage with prior art CMP tool configuration is the difficulty in achieving uniform polishing of the wafers due to the conventional distribution of slurry under the wafer during polishing. Conventional slurry delivery systems, while providing adequate amounts of slurry to the wafer edge, do not deliver enough slurry to the wafer center. Non-uniform slurry delivery is further exacerbated by the tool configuration because the wafer carrier is substantially disposed over the polishing tool. Thus, the inadequate slurry delivery results in non-uniform polishing which leads to defects on the wafer surface.

Still another disadvantage of the prior art polishing tools is the inability to provide more than one polishing application at a time. Conventional methods require that two or more polishers must be used sequentially to provide different rotational speeds of the polisher, or different textures of the polishing pads. For example, if a unique surface required polishing with polishing pads of different textures, the polishing must be performed sequentially by multiple polishing steps which is very costly and non-manufacturable. Furthermore, the necessity for multiple, sequential polishing steps require that more than one polishing tool be placed inside the clean room used during wafer manufacture taking up valuable space.

A further disadvantage of the prior art is the cumbersome in-situ methods to detect the planarization endpoint of the films on the semiconductor wafer. Since the wafer carrier is typically positioned face down over the polishing platen, it is difficult and time consuming to determine the endpoint of the film being polished without stopping the polishing process to make a determination. In-situ methods may be used which are traditionally installed inside the platen and a transparent window provided in the polishing pad. However, these in-situ methods are subject to the corrosive effects of the slurry and the quality of the detected signal is diminished since a direct measurement is not possible.

Bearing in mind the problems and deficiencies of the prior art, it is therefore an object of the present invention to provide a method of and apparatus for planarizing semiconductor wafers or other articles in need of polishing wherein different planarization conditions may be utilized substantially simultaneously.

It is another object of the present invention to provide a method of and apparatus for matching the rotational speed of the polishing platen with the rotational speed of the wafer carrier to provide enhanced uniformity in planarization.

It is yet another object of the present invention to provide a chemical mechanical polishing tool which provides improved slurry delivery for enhanced planarization of the object being polished.

Yet another object of the present invention is to provide a method and apparatus for in-situ endpoint detection of the thickness of films being polished on a semiconductor wafer.

Still other objects and advantages of the invention will in part be obvious and will in part be apparent from the specification.

SUMMARY OF THE INVENTION

The above and other objects and advantages, which will be apparent to one of skill in the art, are achieved in the present invention which is directed to, in a first aspect, a tool for polishing semiconductor wafers of a pre-determined diameter comprising at least two polishing platens, the platens being positioned adjacent to each other such that polishing portions of the platens are substantially co-planar; and at least one wafer carrier moveably mounted to be positioned over the platens such that a semiconductor wafer may be polished by the platens substantially simultaneously. Preferably, each of the platens have a diameter substantially equal to the pre-determined diameter of a wafer carrier in need of polishing and wherein the at least two platens comprises three platens or wherein the at least two platens comprise four platens.

In a further aspect, the present invention is directed to a tool for polishing semiconductor wafers comprising a first polishing platen; a second polishing platen mounted adjacent to the first polishing platen, the first and second polishing platens positioned substantially co-planar too each other; and at least one wafer carrier moveably mounted adjacent the platens such that one or more semiconductor wafers mounted to the carrier may be polished by the platens substantially simultaneously. Preferably, the tool further includes a third polishing platen. Alternatively, the tool further includes both a third polishing platen and a fourth polishing platen.

The preferred embodiments of polishing tools in accordance with the present invention may further include a slurry distribution system and/or an endpoint detection system.

In a final aspect, the present invention is directed to a method of polishing a semiconductor wafer comprising the steps of: (a) providing a polishing tool comprising at least two polishing platens, the platens being positioned adjacent to each other such that polishing portions of the platens are substantially co-planar; and at least one wafer carrier movably mounted adjacent the platens such that one or more semiconductor wafers mounted to the carrier may be polished by the at least two platens substantially simultaneously; (b) providing at least one semiconductor wafer in need of polishing; (c) contacting the semiconductor wafer to the polishing platens; (d) polishing the semiconductor wafer; and (e) removing a desired thickness of the semiconductor wafer.

BRIEF DESCRIPTION OF THE INVENTION

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
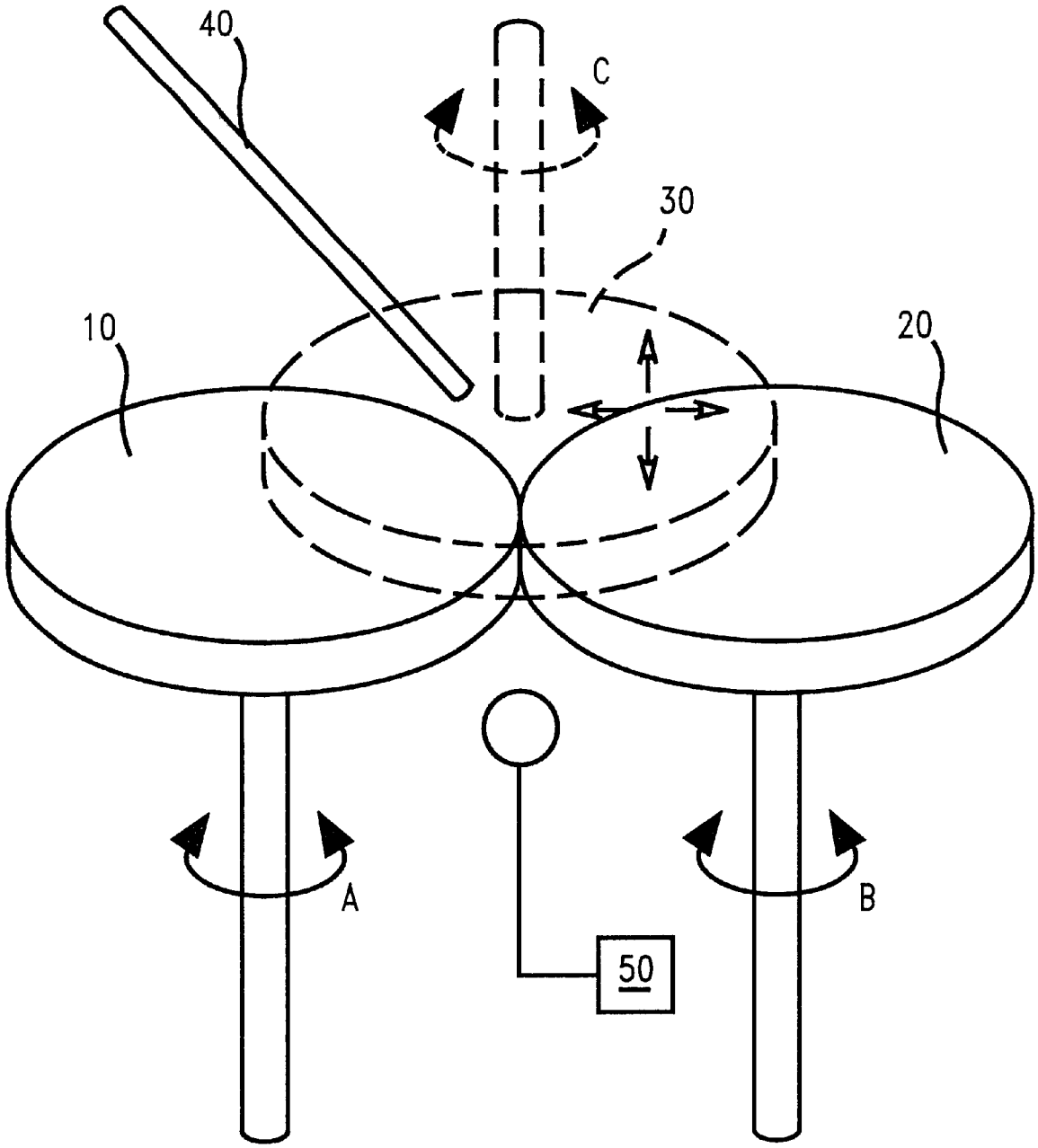
FIG. 1 is a perspective view of a multiple platen polishing tool in accordance with the present invention.

In describing the preferred embodiment of the present invention, reference will be made herein to FIGS. 1–6 of the drawings in which like numerals refer to like features of the invention. Features of the invention are not necessarily shown to scale in the drawings.

The present invention discloses an off-concentric CMP tool having multiple polishing platens, e.g., at least two polishing platens. The off-concentric nature of the present invention provides a platen configuration wherein a wafer carrier holding a semiconductor wafer for polishing is disposed over at least two platens substantially similar in size to the wafer and positioned adjacent to each other such that the wafer may be polished by more than one platen simultaneously.

Surprisingly, utilizing multiple platens in the off-concentric configuration of the present invention provides additional variables for optimizing uniformity of planarization. Polishing an object, such as a semiconductor wafer, utilizing multiple platens in an off-concentric configuration provides greater polish control by adjusting the speed at which each platen is rotating relative to the wafer carrier. The present invention also provides improved slurry access since the slurry does not need to work itself towards the center of the wafer or wafer carrier which is completely covered by the platen in conventional polishing tools. Given the off-concentric configuration of the multiple platens, the slurry is accessible to all portions of the wafer since the wafer is not completely covered by any single platen. Also, in-situ measurements for endpoint detection may be performed by utilizing an endpoint detection scheme which measures the thickness of the wafer or detects a desired endpoint material at a portion of the wafer not covered by the platen. Furthermore, a unique application of the present invention utilizes polishing pads of differing hardness and texture to achieve unique results in which using the conventional method can be done only through sequential polishing using two or more polishers. Finally, space in the clean room is conserved by having multiples of smaller platens which have a smaller footprint than a conventional polishing tool which requires a platen having a diameter at least twice as large as the wafer carrier.

FIG. 1 illustrates a prospective view of a preferred embodiment of the present invention. As shown, first platen 10 and second platen 20 are positioned substantially adjacent to each other, e.g., side by side in the case of two platens, without contacting each other. Wafer carrier 30 is positioned over first platen 10 and second platen 20 and is rotatable in a direction represented by arrow C. Most preferably, the diameter of the platens is substantially similar in size to the wafer carrier. Typically, wafer carrier 30 may hold a semiconductor wafer for polishing by means of vacuum pressure such that the wafer surface in need of polishing is placed face down against both first platen 10 and second platen 20. The rotation of either of the first and second platens may be adjusted independent of each other such that one is rotating clockwise while the other is rotating counter-clockwise. While the polishing platens may rotate independently, their translational motion is preferred to be in sync. Most preferably, the relative translational motion between the platens and the carrier are in sync.

Figure 2:
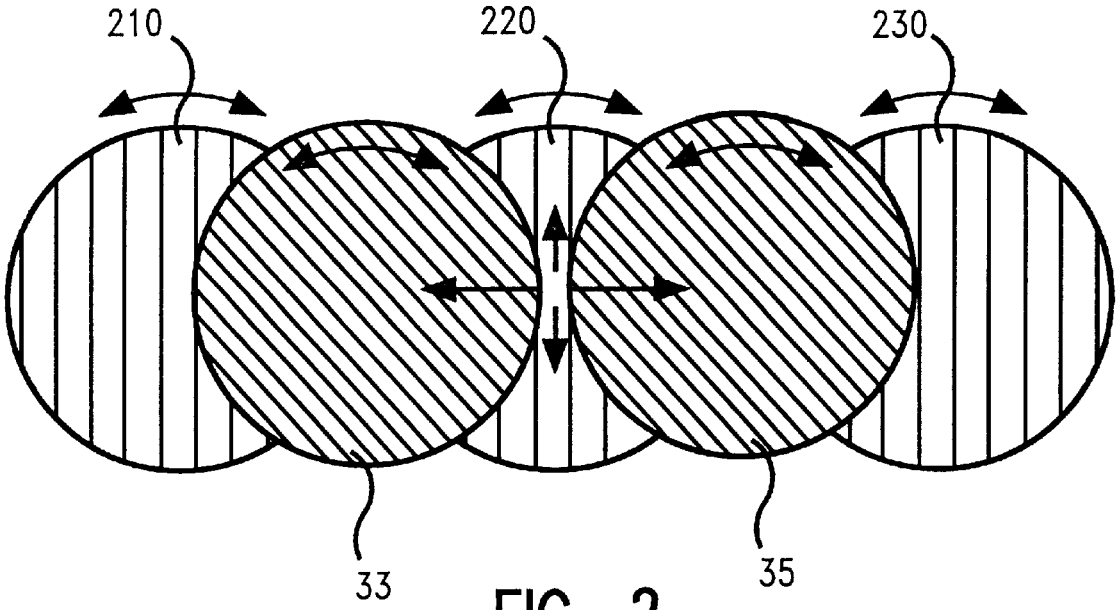
FIG. 2 is a top plan view of a preferred embodiment of a multiple platen polishing tool having a linear configuration in accordance with the present invention.
Figure 3:
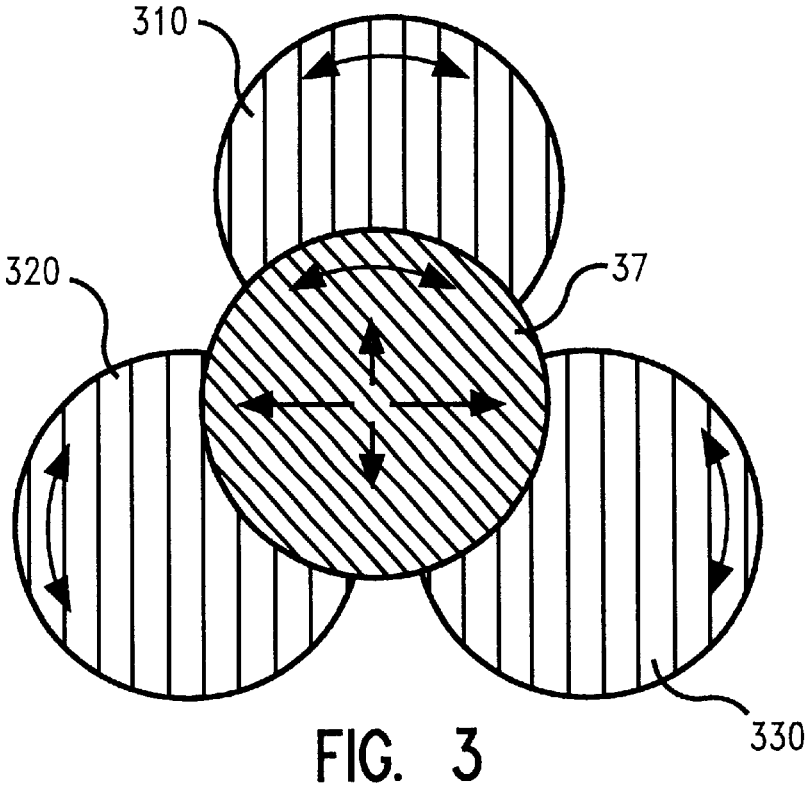
FIG. 3 is a top plan view of a preferred embodiment of a multiple platen polishing tool having a non-linear configuration in accordance with the present invention.
Figure 4:
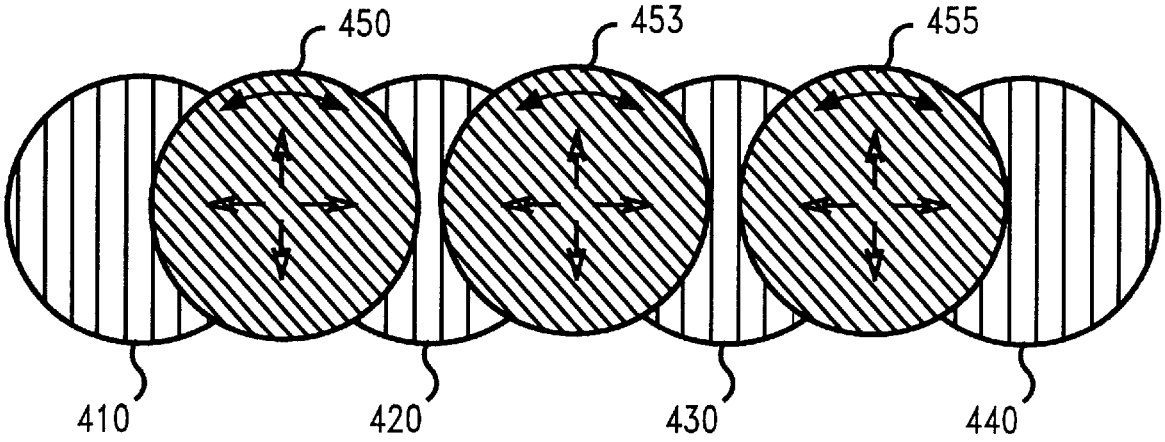
FIG. 4 is top plan view of another preferred embodiment of a multiple platen polishing tool having a linear configuration in accordance with the present invention.
Figure 5:
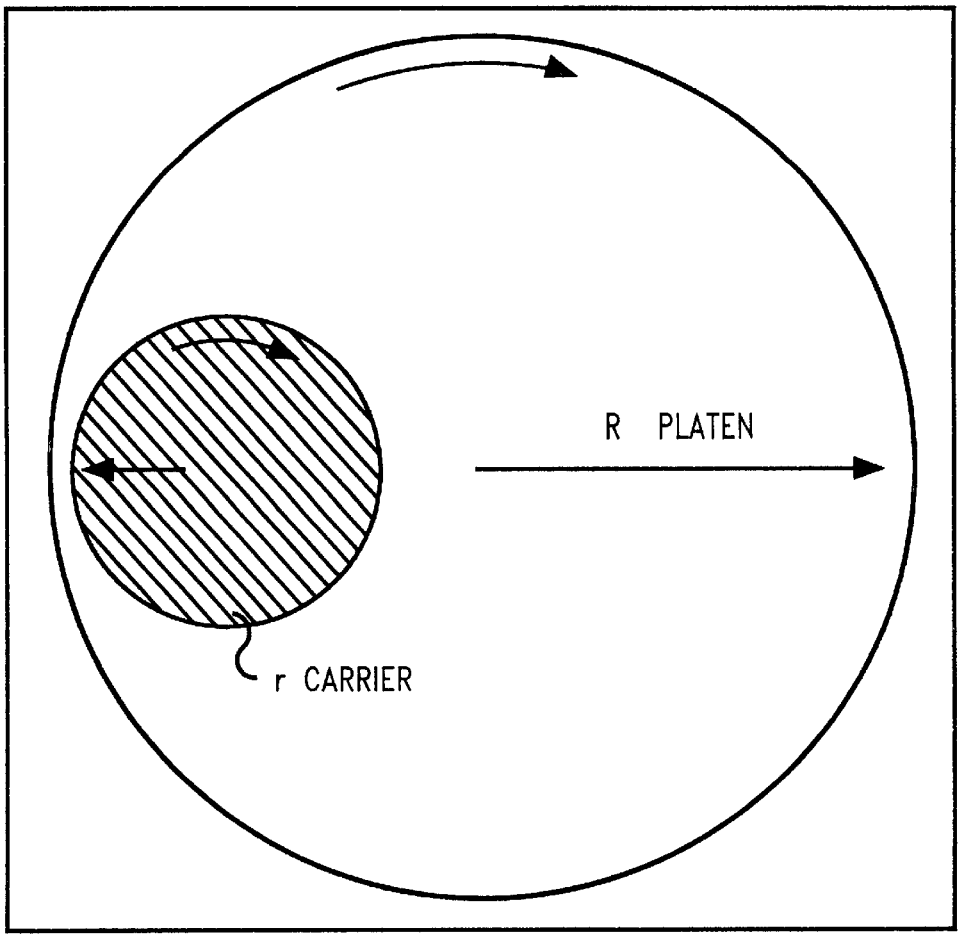
FIG. 5 (Prior Art)
FIG. 5 is a top plan view of a footprint of a prior art single platen polishing tool.

FIGS. 2 and 3 illustrate alternative embodiments of a three platen polishing tool. In FIG. 2, platens 210, 220, and 230 are positioned in a linear configuration with two wafer carriers 33 and 35 positioned over the interface of two platens such that each wafer carrier is being polished off-concentrically by two platens simultaneously. Thus, a multiple platen configuration as disclosed in FIG. 2 is used to process multiple wafers simultaneously, preferably polishing the wafers in their respective carriers 33 and 35 along the same plane. As shown in FIG. 4, wherein the platens are positioned in a linear configuration, an N number of platens 410, 420, 430 and 440 (N=4) may preferably be positioned with an N−1 number of wafer carriers 450, 453, and 455 (N−1=3). Preferably, the rotational direction and the velocity of the platens may be adjusted such that different polishing characteristics are achieved at particular points on each wafer.

In FIG. 3, platens 310, 320, and 330 are positioned in a triangular configuration such that the wafer held in wafer carrier 37 is capable of being polished by all three platens substantially simultaneously. In other non-linear configurations, an N number of polishing platens preferably have an N−2 number of wafer carriers. By providing more than one platen as in this preferred embodiment and in the preferred embodiments of FIGS. 1, 2 and 4, additional variables such as the second and/or third platen rotational speeds, may be "matched" with the rotational speed of the wafer carrier to optimize uniformity of polishing. In contrast, the prior art CMP tools only had two variables with which to optimize uniformity in polishing, the rotational speed of the single platen and the rotational speed of the wafer carrier, and when factoring in the polishing pad texture or hardness, was extremely difficult to optimize.

By using polishing pads of different hardnesses and textures simultaneously, improved polishing effects are achieved. A harder and less compressible polishing pad is used to achieve better planarity since it reduces step height of the wafer surface more efficiently. However, the harder polishing pads more easily introduce defects such as micro-scratches onto the polished wafer surface. Thus, a softer pad would provide a more conformal polishing effect reducing the introduction of defects yet does not reduce step height as efficiently. The ability to use both a hard and soft pad substantially simultaneously rather than sequentially allows for improved polishing of large areas of non-planarity with the hard pad while reducing the introduction of defects with the soft pad.

Polishing pads are also available in differing textures to vary the slurry distribution and as a means of removing debris away from the wafer. For example, although polishing pads may be plain and flat, perforated pads which contain an even distribution of small holes hold more slurry for faster and more efficient polishing. Pads which are embossed with an even distribution of small pyramids or grooved with concentric trenches provide better flow for the slurry and the debris. The use of differing polishing pad textures may utilize a first polishing pad which has excellent slurry distribution while also using a second polishing pad with enhanced debris removal not found in the first pad.

A major advantage over the prior art is the ability to incorporate endpoint detection systems within the current invention. As shown in FIG. 1, endpoint detection system 50 is conveniently positioned between the two adjacent platens 10 and 20 or in between any two platens regardless of the platen configuration. When polishing dielectric films, the thickness or presence of another material of the dielectric may be directly measured by an optical measurement instrument without the need for installing the measurement instrument or sensors inside the platen or providing a window in the polishing pad. This also increases the useful life of the measurement instrument as it does not come in contact with the corrosive slurry. When polishing metal films, the ability to directly measure the planarization endpoint of the film provides increased sensitivity and accuracy of the measurement. The present invention provides direct measurement of the films without significant negative effects to the quality of the signal from having to detect the signal through one or more layers of material.

Another advantage of the present invention is the improved slurry distribution when using a slurry delivery system in conjunction with the current invention. With the multiple platen configuration, slurry delivery is significantly improved to contact all points on the wafer. As shown in FIG. 1, slurry delivery system 40 may be positioned in between the multiple platens such that the slurry may be sprayed directly onto a portion of the wafer not covered by the platen. Alternatively, the slurry may be delivered onto the polishing pad such that during polishing with a multiple platen polishing tool wherein the wafer carrier is not completely covered by one platen, the slurry is able to get beneath the wafer and to its center thus, providing more uniform polishing. Yet a further advantage of the present invention is the capability for adding multiple chemicals or slurries to alter polishing conditions wherein the polishing pad of each platen has a different chemical or slurry.

Figure 6:
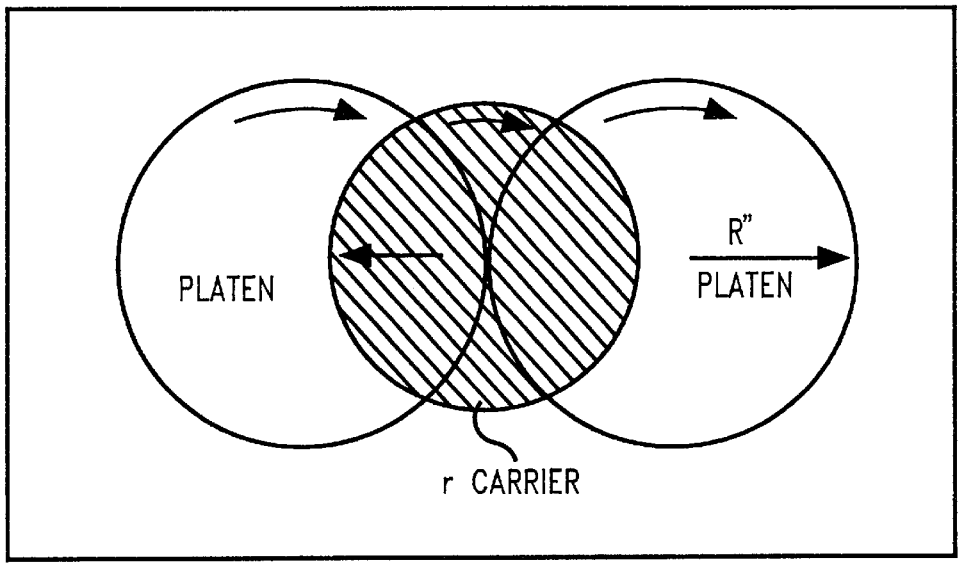
FIG. 6 is a top plan view of a footprint of a multiple platen polishing tool in accordance with the present invention.

Finally, the configuration of the multiple platen polishing tool allows for a smaller footprint in the overall size of the tool thereby diminishing the already limited clean room space needed for manufacture. Typical wafer carriers have a radius r of about 4.5 inches to hold 8 inch wafers. Conventional polishing tools with a single platen, shown in FIG. 5, typically has a radius R greater than twice the size of the wafer carrier, e.g., about 10 to about 11 inches. In accordance to the present invention, when a linear configuration of two polishing platens, as shown in FIG. 6, has a radius R" being of about equal or slightly greater than the radius of the wafer carrier, e.g., about 4.5 to about 5 inches, the footprint of the polishing tool is significantly reduced. Thus, polishing tools of the present invention may be designed to accommodate the different sizes of the semiconductor wafers being polished and configured accordingly.

The present invention achieves the objects recited above. The off-concentric CMP tool of the present invention provides for planarizing semiconductor wafers utilizing different polishing pad hardnesses and textures to achieve planarization effects which prior to the present invention was only available through multiple, sequential polishing steps. By "matching" the rotational speed of the wafer carrier to each polishing platen, enhanced uniformity in planarization is optimized. The off-concentric configuration of the multiple platens also provides improved access to the wafer for single or multiple slurry distribution and in-situ endpoint detection. Furthermore, by configuring the size of each of the multiple platens to be about the size of the wafer carrier, the smaller footprint of the tool provides improved apportionment of the already limited clean room space.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method of polishing a semiconductor wafer comprising the steps of:

(a) providing a polishing tool comprising at least two polishing platens, said platens being off-concentric and positioned adjacent to each other such that polishing portions of said platens are substantially co-planar; and at least one wafer carrier movably mounted adjacent said platens;

(b) providing at least one semiconductor wafer mounted to said wafer carrier in need of polishing;

(c) contacting said semiconductor wafer to said at least two polishing platens;

(d) polishing said semiconductor wafer with said at least two platens substantially simultaneously; and (e) planarizing said semiconductor wafer.

2. The method of claim 1 wherein step (a) comprises providing a polishing tool having N number of off-concentric polishing platens in a linear configuration and N−1 number of wafer carriers.

3. The method of claim 1 wherein step (a) comprises providing a polishing tool having N number of off-concentric polishing platens in a non-linear configuration and N–2 number of wafer carriers.

4. The method of claim 1 wherein step (a) comprises providing a polishing tool further including a slurry distribution system.

5. The method of claim 1 wherein step (a) comprises providing a polishing tool further including an endpoint detection system.

* * * * *